United States Patent [19]

Maschke

[11] 4,401,918

[45] Aug. 30, 1983

[54] KLYSTRON HAVING ELECTROSTATIC QUADRUPOLE FOCUSING ARRANGEMENT

[75] Inventor: Alfred W. Maschke, East Moriches, N.Y.

[73] Assigne: The United States of America as represented by the U.S. Department of Energy, Washington, D.C.

[21] Appl. No.: 205,070

[22] Filed: Nov. 10, 1980

[51] Int. Cl.[3] ..... H01J 23/08

[52] U.S. Cl. ..... 315/5.34; 315/5.35; 315/5; 315/5.37

[58] Field of Search ..... 315/3, 4, 5, 5.34, 5.35, 315/5.39

[56] References Cited

U.S. PATENT DOCUMENTS

| | | | |
|---|---|---|---|
| 2,834,908 | 5/1958 | Kompfner | 315/3.6 |
| 2,849,634 | 8/1958 | Crowley-Milling | 315/5 |
| 2,879,439 | 3/1959 | Townes | 315/5.34 X |
| 2,904,720 | 9/1959 | Bell | 315/5.34 |
| 2,925,508 | 2/1960 | McClure | 315/5.39 X |
| 3,147,445 | 9/1964 | Wuerker et al. | 315/3 |
| 3,521,117 | 7/1970 | Schmidt | 315/5.34 |
| 3,886,399 | 5/1975 | Symons | 315/5 |

*Primary Examiner*—Saxfield Chatmon, Jr.

[57] ABSTRACT

A klystron includes a source for emitting at least one electron beam, and an accelerator for accelarating the beam in a given direction through a number of drift tube sections successively aligned relative to one another in the direction of the beam. A number of electrostatic quadrupole arrays are successively aligned relative to one another along at least one of the drift tube sections in the beam direction for focusing the electron beam. Each of the electrostatic quadrupole arrays forms a different quadrupole for each electron beam. Two or more electron beams can be maintained in parallel relationship by the quadrupole arrays, thereby enabling space charge limitations encountered with conventional single beam klystrons to be overcome.

5 Claims, 4 Drawing Figures

KLYSTRON HAVING ELECTROSTATIC QUADRUPOLE FOCUSING ARRANGEMENT

BACKGROUND OF THE INVENTION

The U.S. Government has rights in this invention pursuant to Contract Number DE-AC02-76CH00016, between the U.S. Department of Energy and Associated Universities, Inc.

The present invention relates generally to klystrons, and more particularly to a klystron structure wherein a number of parallel electron beams are provided with an electrostatic focusing arrangement.

Conventional klystrons were developed to overcome inherent problems with conventional vacuum tubes, which problems acted to prevent the obtainment of any significant R.F. power output at frequencies in the U.H.F. range and higher. At these frequencies, the transit time of the electron beam in a conventional vacuum tube, that is, the time it takes a group of electrons to travel from the filament or cathode to the anode of the tube, becomes a substantial portion of the R.F. cycle (the time period for one cycle at the operating frequency). It thus becomes impossible to develop sharply defined bursts of electron flow from the cathode to the anode, since that flow is regulated by a potential on the tube grid, and the grid potential is varied at the same radio frequency rate by the driving source.

The transit problem in conventional vacuum tubes is used to advantage in the klystron, through a technique called velocity modulation. In place of the cathode, grid and anode of the conventional tube, the basic parts of the klystron include an electron gun, drift tube, resonant cavities and a collector. The electron gun itself includes a cathode, anode and focusing electrode which together form the electron beam. Only a single electron beam has been employed in all klystrons known to have been commercially produced thus far.

The drift tube consists of a number of aligned tube sections, and adjacent sections are spaced apart to define interaction gaps. Each gap is located in a different resonant cavity. A simple two-cavity klystron has only a resonant input cavity and a resonant output cavity, although most power klystrons have three or more cavities to provide higher gain and efficiency than a two-cavity device. The interaction gap within the input cavity is subjected to an R.F. voltage field induced in that cavity by an R.F. input applied to the input cavity by conventional coupling techniques. Electrons flowing past this gap thus are slightly accelerated or retarded in their velocity, depending upon the particular half cycle of R.F. voltage developed across the interaction gap within the input cavity. The beam, as it continues through the drift tube, is now velocity modulated in that some of the beam electrons are travelling faster, while other are moving slower than the average speed. As the faster moving electrons overtake the slower moving ones, a "bunching" phenomenon occurs. When the bunched electrons flow through the interaction gap provided within the resonant output cavity, sharp pulses of R.F. current are coupled to that cavity and allow an R.F. output to be obtained from the output cavity which, in turn, can be applied to a transmission line or wave guide. As the electron beam continues to move through the drift tube out from the output cavity, it strikes the collector and the electrons are returned, through a high voltage supply, to the cathode.

Conventional klystrons include magnet coils and a magnet frame assembly which operate to maintain the electron beam in focus as it passes from the electron gun, and through the drift tube sections toward the collector. The frame assembly with the magnet coils make the conventional klystrons rather bulky and difficult to support by way of a simple socket.

It will be understood that the use of multiple, parallel electron beams in a klystron structure would realize significant gains in operating efficiency, and would permit the overall dimensions of the klystron to be reduced for any given frequency and desired power level. This is so because the space charge limitations encountered with a single electron beam, that is, the tendency of individual electrons within the beam to separate from one another since they each bear the same negative charge, can only be overcome by providing correspondingly higher accelerating potentials and stronger magnetic focusing fields on the single beam. Such measures obviously require the overall size of the klystron including its magnet assemblies to become larger, and that electrode spacings within the klystron increase in order to tolerate the higher operating potentials.

The use of a number of parallel electron beams, however, insofar as space charge considerations are concerned, requires that the accelerating potentials and focusing fields be of sufficient magnitude to accomodate the beam having the largest cross-sectional area, rather than the total cross-sectional area of the individual beams. Of course, the beams themselves should be maintained separated from one another by sufficient distances to prevent interactions.

A focusing arrangement which is uniquely suitable for use in a klystron structure, and which will allow a number of parallel electron beams to be employed in the klystron, is disclosed in applicant's pending U.S. patent application Ser. No. 152,461, filed May 23, 1980, entitled, "Means and Method for the Focusing and Acceleration of Parallel Beams of Charged Particles". Relevant portions of this application are incorporated by reference herein.

As disclosed in the above application, a number of parallel beams or "beamlets" are focused by way of electrostatic quadrupoles. A quadrupole is an assembly of four electrodes each having a center on the circumference of a circle, and separated successively by 90°. Each of the electrodes is connected to a DC voltage, the electrode polarities being the same for opposing pairs of electrodes, and opposite for adjacent electrode pairs along the circle. FIG. 4 of the '461 application shows a drift tube section including a planar quadrupole array for allowing passage of and for focusing the parallel beamlets in a direction perpendicular to the plan of the quadrupole array, each beamlet passing through the center of a different quadrupole assembly. FIG. 5 of the '461 application shows a number of the drift tubes successively aligned to form a linear accelerator.

Importantly, the potentials applied to adjacent quadrupole electrodes in the direction of the beamlets are alternated to realize a strong net focusing effect on each beamlet as it travels through the drift tube sections.

In accordance with the present invention, a klystron includes means for emitting at least one electron beam, and means for accelerating the beam in a given direction. A number of drift tube sections are successively aligned relative to one another in the direction of the electron beam to velocity modulate the beam in response to radio frequency energy coupled to the drift tube sections. A number of electrostatic quadrupole arrays are successively aligned relative to one another along at least one of the drift tube sections in the beam direction to focus the beam, and each of the quadrupole arrays forms a different quadrupole for each electron beam.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
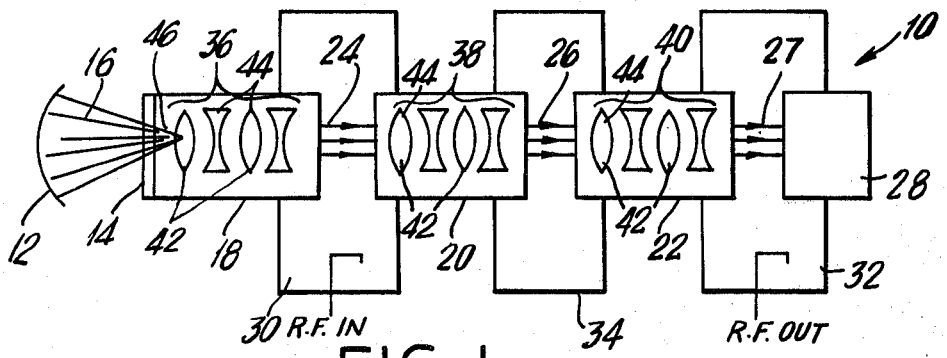
FIG. 1 is a schematic representation of a klystron including an electrostatic quadrupole focusing arrangement according to the present invention.

FIG. 1 is a representation of a klystron 10 according to the present invention. The klystron 10 includes a conventional electron emitting source or cathode 12, and an accelerating electrode or anode 14 which, when connected to a sufficiently high voltage source, causes a stream of electrons 16 to be accelerated from the emitting surface of the cathode 12. Although only a single cathode 12 and anode 14 are shown in FIG. 1 for producing the accelerated electron stream 16, a number of cathode-anode pairs corresponding to a desired number of electron beams to be employed in the klystron 10 may be provided, or a single cathode-anode pair may be used together with additional suitable structures (not shown) to allow the desired number of electron beams to be obtained from the single cathode 12.

Klystron 10 also includes three axially aligned drift tube sections 18, 20 and 22. Adjacent drift tube sections are spaced apart to define interaction gaps 24, 26 and 27. A collector 28 is arranged at the end of drift tube section 22 for collecting electrons passing through the tube section 22 and returning the electrons to the cathode 12 through a high voltage source (not shown).

An input resonant cavity 30 is provided around the interaction gap 24 between drift tube sections 18, 20, and an output resonant cavity 32 is provided at the end of the drift tube section 22 from which electrons pass through the interaction gap 27 to strike the collector 28. A third resonant cavity 34 is provided around the interaction gap 26 between drift tube sections 20 and 22, the cavity 34 being resonant, for example, at the second harmonic of the radio frequency energy applied to the input cavity 30. The particular number of resonant cavities provided in the klystron 10, and the relationship among the resonant frequencies of the cavities, are matters which can be freely selected, the present invention not being limited to the specific arrangement of cavities shown in FIG. 1.

Three electrostatic quadrupole focusing arrangements 36, 38 and 40 are each provided along a different one of the drift tube sections 18, 20 and 22. Each of the quadrupole focusing arrangements 36, 38, 40 includes a number of focusing quadrupole arrays 42 and a corresponding number of defocusing quadrupole arrays 44. The quadrupole arrays 42 and 44 are successively, alternatingly aligned relative to one another along each of the drift tube sections 36, 38 and 40 in the direction of electron beam travel within the drift tube sections.

As a result of the above construction, a number of electron beams 46 entering the drift tube section 18, after being accelerated by the anode 14, will be aligned parallel to one another and maintained in parallel relationship as the beams pass through each of the drift tube sections 36, 38, 40 and between the interaction gaps 24, 26 and 27.

Figure 2:
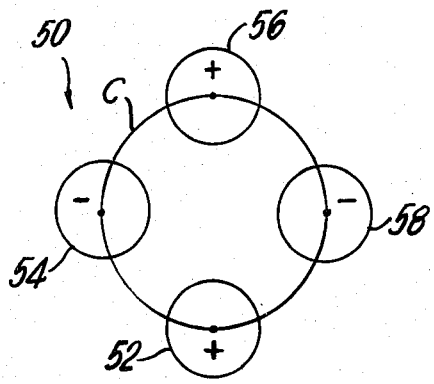
FIG. 2 is a schematic representation of a single electrostatic quadrupole.

FIG. 2 shows a single electrostatic quadrupole which includes four electrodes 52, 54, 56 and 58. Each of the electrodes has its center on the circumference of a circle C, and is separated from adjacent electrodes by 90°. The electrodes are arranged to be connected to a DC voltage source so that the electrode polarities are the same for opposing pairs of electrodes, and opposite for the adjacent pairs along the circle C, as shown. It will be understood that an electron beam travelling in a direction normal to the plane of the electrostatic quadrupole in FIG. 2, at or near the center of the circle C, will have a centering force exerted thereon by the negatively charged electrodes 54, and 58, and an orthogonally directed, off-centering force exerted thereon by the positively charged pair of electrodes 52 and 56. Accordingly, the next electrostatic quadrupole to that shown in FIG 2 in the direction of the electron beam, must have electrons which are polarized oppositely to the corresponding electrodes of the quadrupole in FIG. 2. This will compensate for any off-centering force experienced by electrons of the beam after they have passed through the quadruple in FIG. 2. Accordingly, the quadrupole of FIG. 2 may be regarded as a "focusing" quadrupole, while quadrupoles next adjacent the quadrupole of FIG. 2 in the direction of the electron beam may be regarded as "de-focusing" quadrupoles, or vice-versa.

Figure 3:
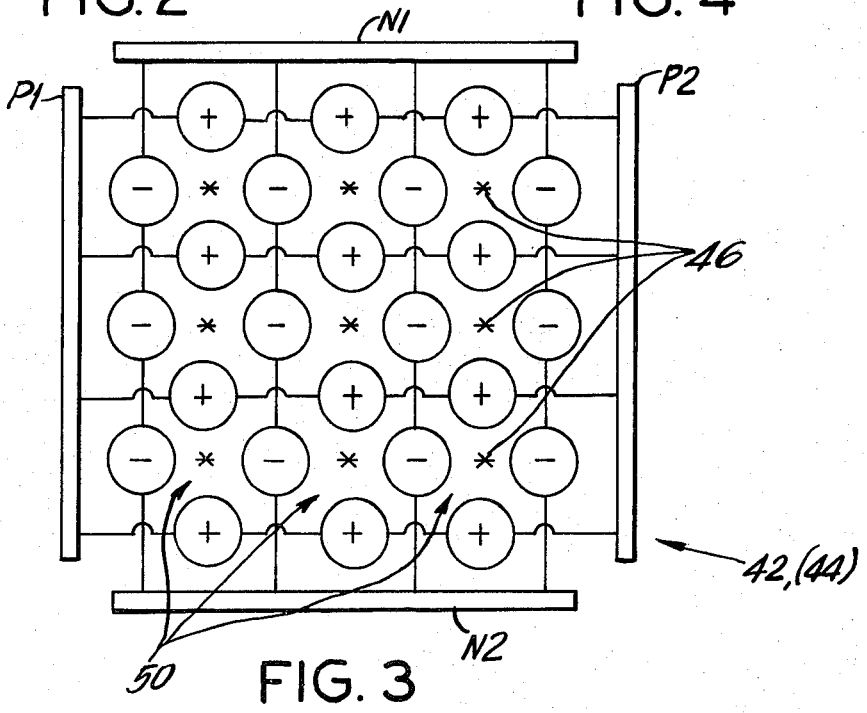
FIG. 3 is a schematic representation of an electrostatic quadrupole array as viewed in the direction of a number of parallel electron beams which are focused by the array.

FIG. 3 represents either the focusing quadrupole array 42, or the de-focusing quadrupole array 44 in FIG. 1. The quadrupole array of FIG. 3 includes a planar array of electrodes which form a total of nine electrostatic quadrupoles, each quadrupole acting on a different one of the electron beams 46. Some of the electrodes of the array of FIG. 3 are shared in common by adjacent ones of the quadrupoles 50, as shown. Those electrodes which carry a positive polarity are arranged to be interconnected through terminal electrodes P1 and P2, and those electrons which are to be negatively polarized are interconnected with one another by way of electrode terminal pair N1 and N2. As mentioned above, adjacent quadrupole arrays in the direction of the electron beams 46 must have their electrodes polarized oppositely from the corresponding electrodes of the array of FIG. 3.

Figure 4:
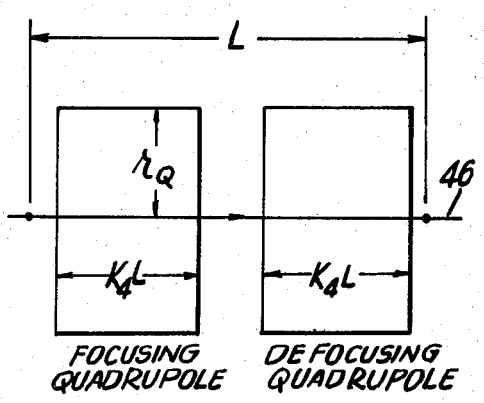
FIG. 4 is a schematic representation of adjacent electrostatic quadrupoles in the direction of an electron beam.

The following theoretical discussion demonstrates the advantages of the multiple electron beam approach over the use of a single electron beam with regard to space charge limitations. FIG. 4 represents a focusing quadrupole and an adjacent de-focusing quadrupole in the direction of one of the electron beams 46, both of these quadrupoles together forming a "focusing cell". This cell has an overall length L in the direction of the electron beam 46, and a radius $r_Q$ relative to the beam 46.

The space charge limits for an electrostatic quadrupole system can be summarized by the following four equations, wherein MKS units are used throughout, and the following units have the corresponding definitions.

$i_{maxT}$—the maximum transportable current in a quadrupole channel due to consideration of transverse space charge.

$\epsilon_{NT}$—the normalized emittance area/$\pi$. For a beam at the space charge limit the beam emittance and the channel acceptance are the same.

$\mu_o$—the betatron oscillation phase advance per cell.

k—the ratio of space charge force to mean restoring force of the quadrupole channel.

$k_3$—the radius of the quadrupoles in units of cell length, i.e., $k_3 - r_Q/L$ $k_4$—the quadrupole length in the same units.

$\eta$—the ratio of average to maximum beam size in the focusing structure. Typical values are 0.7 to 0.8. The effect of space charge is to bring $\eta$ closer to unity than it would be in the same channel without space charge.

A—ratio of the electron mass to the proton mass z—the electron charge state $E_{Qmax}$—the pole tip field of the quadrupoles $\beta$—ratio of the electron velocity to the velocity of light c—the velocity of light $\gamma$—$(1-\beta^2)^{-\frac{1}{2}}$ The first equation is as follows:

$$i_{maxT} = 10.2\left[\frac{k}{(1-k)^{\frac{1}{4}}}(\mu_o k_4)^{\frac{3}{2}}\right]\left(\frac{A}{Z}\right)^{\frac{1}{2}}\epsilon_{NT}^{\frac{3}{2}}E_{Qmax}^{\frac{3}{2}}\beta\gamma^{5/3} \quad (1)$$

Both $\epsilon_{NT}$ and $E_{Qmax}$ now can be expressed in terms of the above parameters and the length L of the focusing cell. Thin-lens expressions are used for simplicity. At phase advances $\leqq 90°$ per cell, very little error is introduced.

$$\epsilon_{NT} = [\eta^2 k_3^2(1-k)^{\frac{1}{2}}]\beta\gamma L \quad (2)$$

$$E_{Qmax} = \left[\mu_o\frac{k_3}{k_4}6.26\right]c\frac{A}{z}\frac{\beta^2\gamma}{L} \quad (3)$$

Inserting (2) and (3) into (1), we obtain an expression for the maximum transportable current which is independent of $\epsilon_{NT}$, $E_{Qm}$ and L;

$$i_{maxT} = 1.56\times 10^7[k\mu_o^2 k_3^2\eta^{4/3}]\frac{A}{z}(\beta\gamma)^3 \quad (4)$$

Now all of the variables contained within the brackets are bounded. For instance, $\mu_o \leqq \pi/2$ for stable high current beam transport. First order stability requires $k \leqq 1$. The bound on $k_3$ is less precise. Clearly, a linear focusing channel cannot be filled with quadrupoles having apertures much greater than their length. It is assumed that $k_3 \leqq \frac{1}{8}$. A detailed analysis might allow one to increase this slightly. $\eta$ clearly must be $<1$. Putting in the maximum values, we obtain $$i_{maxT} \leqq 5.5\times 10^5\frac{A}{z}(\beta\gamma)^3$$

Specifically for electrons, we obtain $$i_{maxT} \leqq 300(\beta\gamma)^3 \quad (5)$$

This corresponds to a perveance of about $2\times 10^{-6}$. A practical system might be lower by a factor of about 2.

When currents above the space charge limits are transported in a strong focusing channel, the beam "blows up", i.e., its emittance increases, and then it hits the aperture and is lost. However, this "blowup" requires a few betatron oscillations. Therefore, it is possible to exceed the "stable" transport limits for a short time. Indeed, if the time is short enough (1 or 2 beam plasma oscillations) it is possible to violate the $k \leqq 1$ condition. This is certainly an allowable condition for a klystron. For propogation of a beam without blowup, Equation (5) above is probably an overestimate by at least a factor of 2.

The aperture requirement for an electron beam can be obtained from Equation (3). We obtain the following equation for the radius of the quadrupole channel:

$$r_Q = \frac{\mu_o k_3^2\beta^2\gamma}{k_4 E_{Qmax}}\times 10^6 \quad (6)$$

Using the maximum values of $_o$ and $k_3$, and setting $k_4$ at about 0.4, we obtain an expression for the radius of the channel. E typically is about $10^7$ volts per meter.

$$\therefore r_Q \leqq 6\times 10^{-3}\beta^2\gamma$$

It should be noted that $i_{maxT}$ and $r_Q$ are both proportional to $\mu_o k_3^2$. Therefore, the current density is inversely proportional to $\mu_o k_3^2$. This suggests that more beams of smaller diameter should be employed in order to optimize the average current density. Equation (2), for the emittance, puts a lower bound on the radius of the quadrupoles.

The maximum current density in a beam is given by $i_{maxT}/\pi r_Q^2$. Using Equations (4) and (6), we obtain the following expression for the current density:

$$J = 2.7\times 10^{-9}\frac{k\eta^{4/3}k_4^2E_{Qmax\gamma}^2}{\beta k_3^2}\ \text{amps/m}^2$$

Similarly, by multiplying by the kinetic energy per unit change, we obtain an expression of the power density:

$$F = 1.38\times 10^{-3}\frac{k\eta^{4/3}k_4^2E_{Qmax}^2}{k_3^2}\frac{\gamma(\gamma-1)}{\beta} \quad (7)$$

Once again, inserting maximum values for k, $\eta$, $k_4$ and $k_3$, by setting $E_{Qmax} = 10^7$ volts per meter, we obtain:

$$F \leqq 1.4\times 10^{12}\frac{\gamma(\gamma-1)}{\beta}\ \text{watts/m}^2$$

For 250 kV electrons, $\gamma(\gamma-1)/\beta = 1$. A practical array of beams might have a power density reduced by a factor of 10. For example, a 10 cm×10 cm array of beams could carry 1.4 Gigawatts.

The Child-Langmuir relation also puts a current limitations on a single beam of circular aperture. The current density is given by $$J = 2.33 \times 10^{-6} \frac{V^{3/2}}{d^2},$$

where d is the spacing of the extractor electrode. The area of the source cannot be much different than $d^2$, so we get an effective limiting current $i_{maxC-L} \sim 2.33 \times 10^{-6} V^{3/2}$.

For a 60 kV single beam klystron, this is about 34 amperes, which is similar to the quadrupole channel limitation (see Equation (5)).

At least two classes of klystrons according to the invention can be distinguished. In one class, a bundle of beams each of a diameter $<<\lambda = c/f$ can be used. For example, this would be the case for a 10 cm×10 cm bundle of beams in a system operating at a few hundred megahertz. A second class includes the use of a bundle of beams where the beam spacing is on the order of λ. This second class is applicable to the production of millimeter wavelength klystrons.

EXAMPLE 1—A 200 MHz KLYSTRON

Suppose a klystron having 3 Megawatts of R.F. power output is desired. If the efficiency were 50%, this would require 6 Megawatts of D.C. beam current. If a 50Ω outut is desired, we obtain 17 kV for the peak R.F. voltage.

Therefore, it might be appropriate to choose about 20 kV for the electron beam voltage. We then obtain the following parameters:

$P_{RF} = 3$ MW
$P_{DC} = 6$ MW
$V = 20$ kV
$i_{DC} = 200$ amperes
$i_{maxT} = 4.5$ amperes
$\bar{i} = 2$ amperes (Perveance $= 7 \times 10^{-7}$)
$r_{Qmin} = 5 \times 10^{-4}$ for $E_{Qmax} = 10^7$ V/meter
$v_{Quad} = \pm 1.5$ kV A practical array of beams will have their centers separated by about 3 $r_Q$. With a 10 cm×10 cm array of 100 beams, $r_Q$ would be set at about 3 mm. $E_{Qmax}$ would then only be $1.6 \times 10^6$ V/meter for this case.

Since no magnetic field is required for the beam transport, and since electrostatic quadrupoles are extremely inexpensive, there is no great need to shorten the structure. However, if the buncher or resonant cavity voltage is about ±2 kV, the drift length will be about 2 meters.

A current of 200 amperes will generate an exterior magnetic field of about 8 gauss. The current could be cancelled by returning it back through some of the apertures. However, the 8 gauss corresponds to an electric field of only 67 kV/meter. This will result in an average displacement of the "central" beam orbit by about b 1 mm, which is easily compensated for by slightly increasing the quadrupole aperture.

Since the net current is divided into many beams, the total collector area will be much greater than in a typical single beam system. This should enable one to improve on the average power rating. Furthermore, the low voltage also reduces any X-ray hazard associated with conventional single beam, high voltage klystrons.

EXAMPLE 2—A 100 GHz KLYSTRON

A 100 GHz operating frequency corresponds to a wavelength of 3 mm. In order to make a buncher or resonant cavity for 20 kV electrons, a $\beta\lambda/2$ structure would only be about ½ mm long. This implies that the beam diameter must be in the sub-millimeter range in order to avoid having a vanishingly small transit-time factor for the buncher or resonant cavity interaction gap. A radius of 0.25 mm would suffice. This is attainable with electrostatic quadrupoles using peak electric fields of $2 \times 10^7$ V/meter (See, e.g. Example 1). If we reduced the current, i.e. let $k_3 = 0.088$ instead of 0.125, the current goes from 2 amps to 1 amp, and the maximum electric field would be reduced to $1 \times 10^7$ v/meter. The beams are no longer "tight" packed.

In order to make a buncher and collector cavity, we must run the beams at a spatial separation of n λ/2. For n=2, the bunchers are all in phase and the beam separation is 3 mm. Since each beam, assuming 50% efficiency, would provide 10 kW, a rather modest array could produce a few hundred kW. If the buncher voltage is mainted as in Example 1, then the overall length will drop by a factor of about 250. This corresponds to a transport length of about 1 cm.

While specific embodiments of the invention have been shown and described in detail to illustrate the application of the inventive principles, it will be understood that the invention may be embodied otherwise without departing from such principles.

What is claimed is:

1. A klystron comprising means for emitting a plurality of electron beams, means for accelerating the electron beams in a given direction, a number of drift tube sections successively aligned relative to one another in the direction of the electron beams for velocity modulating the electron beams in response to radio frequency energy coupled to said drift tube sections, and a number of electrostatic quadrupole arrays successively aligned relative to one another along at least one of said drift tube sections in the direction of the electron beams for focusing the electron beams and maintaining the electron beams in spaced apart parallel relationship to one another, each of said electrostatic quadrupole arrays including a plurality of electrode in a common plane forming a different quadrupole for each of the electron beams.

2. A klystron according to claim 1, wherein said at least one drift tube section contains a focusing quadrupole array and a de-focusing quadrupole array next adjacent said focusing quadrupole array, said de-focusing quadrupole array having electrodes which are arranged to be polarized oppositely from corresponding electrodes of said focusing quadrupole array.

3. A klystron according to claim 1, wherein each of said quadrupoles formed in each of said electrostatic quadrupole arrays includes an electrode which forms a part of another one of said quadrupoles in the same electrostatic quadrupole array.

4. A klystron according to claim 1, wherein said emitting means is arranged to provide each of the electron beams with a diameter which is less than the wave length of the radio frequency energy by at least a factor of ten.

5. A klystron according to claim 1, wherein said electrostatic quadrupole arrays are arranged to maintain the electron beams spaced apart by distances of about one wave length of the radio frequency energy.

* * * * *